US006689551B1

(12) United States Patent
Begley et al.

(10) Patent No.: US 6,689,551 B1
(45) Date of Patent: Feb. 10, 2004

(54) PHOTOGRAPHIC ELEMENT, COMPOUND, AND PROCESS

(75) Inventors: William J. Begley, Webster, NY (US); Gary M. Russo, Rochester, NY (US); Mathilde R. Triguel, Griesheim (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/325,367

(22) Filed: Dec. 18, 2002

(51) Int. Cl.[7] ..... G03C 1/46

(52) U.S. Cl. ..... 430/505; 552/553; 552/386; 552/387

(58) Field of Search ..... 430/502, 503, 430/505, 543, 552, 553, 386, 387, 376, 379, 523

(56) References Cited

U.S. PATENT DOCUMENTS

| | | | | |
|---|---|---|---|---|
| 4,334,011 | A | 6/1982 | Aoki et al. | |
| 4,540,650 | A | 9/1985 | Klug et al. | |
| 5,262,292 | A | 11/1993 | Krishnamurthy et al. | |
| 5,585,227 | A | 12/1996 | Ishii et al. | |
| 5,925,503 | A | 7/1999 | Harder et al. | |
| 5,962,198 | A | 10/1999 | Lau et al. | |
| 5,972,587 | A | 10/1999 | Romanet et al. | |
| 5,985,533 | A | 11/1999 | Romanet et al. | |
| 6,156,489 | A | 12/2000 | Iwasaki et al. | |
| 6,518,000 | B1 * | 2/2003 | Begley et al. | 430/552 |
| 6,558,886 | B1 * | 5/2003 | Isaac et al. | 430/552 |

FOREIGN PATENT DOCUMENTS

| | | |
|---|---|---|
| DE | 25 29 991 | 1/1976 |
| EP | 0 296 780 | 12/1988 |

* cited by examiner

*Primary Examiner*—Geraldine Letscher

(74) *Attorney, Agent, or Firm*—Arthur E. Kluegel

(57) ABSTRACT

Disclosed is a photographic element comprising a light-sensitive silver halide emulsion layer having associated therewith a phenolic "NB magenta coupler" having the formula:

(I)

wherein:

the term "NB magenta coupler" represents a coupler of formula (I) that forms a magenta dye with the developer 4-amino-3-methyl-N-ethyl-N-(2-methanesulfonamidoethyl) aniline sesquisulfate hydrate for which the maximum absorption of the dye upon spin coating is in the range of from 520 to 590 nm and the left bandwidth (LBW) or the right bandwidth (RBW) using spin-coating, is at least 5 nm less than that of the same dye in solution form;

$R_1$ is a heterocyclic, carbocyclic, or alkenyl group with substituents of sufficient electron withdrawing capacity to obtain a spin-coated dye as described in the preceding subparagraph that exhibits a maximum absorption in the range of 520–590 nm;

Y is H or a coupling-off group;

each Z* is an independently selected substituent group where p is independently 0 to 2;

$R_2$ is a heterocyclic or carbocyclic ring group, or an alkyl group;

provided that when $R_2$ is an alkyl group with an α-alkyl substituent, said α-alkyl substituent is unbranched; and provided further that the combined sum of the aliphatic carbon atoms in $R_1$, $R_2$ and all Z* is at least 8.

31 Claims, No Drawings

PHOTOGRAPHIC ELEMENT, COMPOUND, AND PROCESS

FIELD OF THE INVENTION

This invention relates to a silver halide photographic element containing a phenolic coupler with a carbonamido group in the 2-position and a carbonamido group in the 5-position the latter bearing a strong electron withdrawing group(s), said phenolic coupler capable of forming a magenta dye when reacted with oxidized photographic color developer.

BACKGROUND OF THE INVENTION

In silver halide based color photography, a typical photographic element contains multiple layers of light-sensitive photographic silver halide emulsions coated on a support with one or more of these layers being spectrally sensitized to each of blue light, green light and red light. The blue, green, and red light-sensitive layers typically contain yellow, magenta, and cyan dye-forming couplers, respectively. After exposure to light, color development is accomplished by immersing the exposed material in an aqueous alkali solution containing an aromatic primary amine color-developing agent. The dye-forming couplers are selected so as to react with the oxidized color developing agent to provide yellow, magenta and cyan dyes in the so called subtractive color process to reproduce their complementary colors, blue, green and red as in the original image.

The important features for selecting the dye-forming coupler include, efficient reaction with oxidized color developing agent, thus minimizing the necessary amounts of coupler and silver halide in the photographic element; the formation of dyes with hues appropriate for the photographic use of interest, for color photographic paper applications this requires that dyes have low unwanted side absorption leading to good color reproduction in the photographic print; minimization of image dye loss contributing to improved image permanence under both ambient illumination and conventional storage conditions; and in addition the selected dye-forming coupler must exhibit good solubility in coupler solvents, provide good dispersibility in gelatin and remain stable during handling and manipulation for maximum efficiency in manufacturing processes.

In recent years, a great deal of study has been conducted to improve dye-forming couplers for silver halide photosensitive materials in terms of expanded coupler types, improved color reproducibility and image dye stability. However, further coupler types and improvements are needed. In general, cyan dyes are formed from naphthols and phenols as described, for example, in U.S. Pat. Nos. 2,367,351, 2,423,730, 2,474,293, 2,772,161, 2,772,162, 2,895,826, 2,920,961, 3,002,836, 3,466,622, 3,476,563, 3,552,962, 3,758,308, 3,779,763, 3,839,044, 3,880,661, 3,998,642, 4,333,999, 4,990,436, 4,960,685, and 5,476,757; in French patents 1,478,188 and 1,479,043; and in British patent 2,070,000. More recently, cyan couplers based on 2,5-diacylaminophenols in Lau et al., in U.S. Pat. No. 5,686,235, and Begley et al., in U.S. Pat. Nos. 6,387,606, 6,251,575, 6,207,363, 6,201,125, 6,197,492, 6,197,491, 6,197,490, 6,197,489, 6,194,132, 6,190,850, 6,180,331, 6,180,328, and 6,132,947 form highly desirable cyan narrow bandwidth dyes with improved light and dark stabilities, and less unwanted green absorption. On the other hand, magenta couplers are generally formed from pyrazolones and pyrazolotriazoles as described, for example in U.S. Pat. Nos. 5,262,292, 5,925,503, 5,972,587, 5,985,533 and 4,540,654. Both the cyan and magenta types of couplers can be used either by being incorporated in the photographic silver halide emulsion layers or externally in the processing baths. In the former case the couplers must have ballast substituents built into the molecule to prevent the couplers from migrating from one layer into another. Although these couplers have been used extensively in color photographic film and paper products, the dyes derived from them still suffer from poor stability to heat, humidity or light, low coupling efficiency or optical density, and in particular from undesirable blue and green absorptions which cause considerable reduction in color reproduction and color saturation.

The hue of a dye is a function of both the shape and the position of its spectral absorption band. Traditionally, the magenta dyes used in color photographic papers have had nearly symmetrical absorption bands centered in the region of 530 to 560 nm, more typically in the region of 540 to 555 nm. Such dyes have rather large amounts of unwanted absorption in the blue and red regions of the spectrum.

More desirable would be a dye whose absorption band could be adjusted so as to tune the slope of the curve on both the short and long wavelength sides of the absorption curve. The half-bandwidth on the short side of the curve, also called the left half-bandwidth or LBW, and the half-bandwidth on the long side of the curve, also called the right half-bandwidth or RBW are both desirably narrowed. Such a dye would suitably peak at 550 nm, but the exact position of the desired peak depends on several factors including the degree of asymmetry and the shapes and positions of the absorption bands of the cyan and yellow dyes with which it is associated.

Phenolic couplers invariably react with oxidized color developer to form cyan dyes exhibiting a range of absorption maxima, bandwidths and general curve shapes. The $\lambda_{max}$, or wavelength of maximum absorption, for phenolic couplers usually lies in the red region of the visible spectrum in the range of 590 nm to 680 nm, but more usually between 620 nm and 650 nm. These couplers are highly desirable in the photographic industry because the starting materials needed to prepare them are readily available, they are inexpensive, and they provide dyes with such a wide range of features to choose from.

The introduction of changes to the phenolic coupler, which would provide dyes other than cyan when reacted with oxidized color developer, would be highly desirable. In particular, shifting the absorption curve of the dye or its $\lambda_{max}$ from the red region of the visible spectrum 590–680 nm, into the green region of the spectrum, 530–585 nm, to provide a magenta dye would be very advantageous. Readily available and inexpensive phenols would then provide a common source of two of the dyes used in the photographic industry with a significant cost savings, thus eliminating the need for the more expensive and more difficult to manufacture magenta dye yielding pyrazolone and pyrazolotriazole based couplers.

One way to shift the $\lambda_{max}$ of a dye is through the careful selection and location of substituents on the dye's chromophore. Although individual electron-withdrawing or electron-donating substituents directly attached to the chromophore of a dye is known to affect the dye hue, by shifting the $\lambda_{max}$ to either shorter or longer wavelength, such shifts are usually small. Shifts induced by electron-withdrawing or electron-donating substituents rarely move the dye absorption from one region of the visible spectrum to another. However, the effect of introducing a group of carefully selected electron-withdrawing or electron-donating substituents at specific locations on the dye is unknown.

Begley et al., in co-pending application Ser. No. 10/060,691 filed Jan. 30, 2002, Infrared Couplers for Incorporating and Recovering Metadata, discloses couplers with a 5-carbonamido group, specifically a substituted 5-benzoamido group containing 1 to 4 fluoro substituents. Begley et al., teaches infrared couplers with no reference to phenolic magenta couplers.

Ishii et al., U.S. Pat. No. 5,585,227 suggests certain phenolic couplers having electron withdrawing groups and teaches the use of such couplers as cyan couplers for use in a red-sensitive layer for reducing stains upon processing. There is no indication that said couplers are useful as magenta dye forming couplers in the green-sensitive layer.

Iwasaki et al., U.S. Pat. No. 6,156,489 suggests certain phenolic couplers having an electron withdrawing group with a branched α-alkyl substituent on the 2-carbonamido group and teaches the use of such couplers as cyan couplers for use in a red-sensitive layer for the production of black-and-white or monochromatic images by controlling the relative rates of reaction of couplers in the red, green and blue-sensitive layers. Again, there is no indication that said couplers are useful as magenta dye forming couplers in the green-sensitive layer.

Lau et al., U.S. Pat. No. 5,962,198 suggests certain couplers having a pentafluorophenyl group and teaches their use in the formation of cyan dyes with low wavelength of maximum absorbance, narrow bandwidth and low unwanted green absorbance. Coupler IC-6 in Lau et al., column 9, teaches its use to produce a cyan dye with a $\lambda_{max}$ of 630 nm, column 40, line 62, and is used in a red-sensitive layer.

Masukawa, E.P. 296,780 suggests certain couplers having a pentafluorophenyl group and teaches their use in the formation of cyan dyes.

D.E. 3,045,745 and D.E. 2,529,991 refer to fluorinated alkyl groups on phenolic couplers used to generate cyan dyes.

The problem to be solved is to provide an alternative photographic element, compound, and process, employing a phenolic coupler which forms a magenta dye when reacted with an oxidized color photographic developer.

SUMMARY OF THE INVENTION

The invention provides a photographic element comprising a light-sensitive silver halide emulsion layer having associated therewith a phenolic "NB magenta coupler" having the formula:

(I)

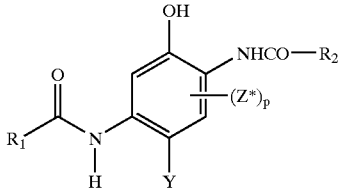

wherein:

the term "NB magenta coupler" represents a coupler of formula (I) that forms a magenta dye with the developer 4-amino-3-methyl-N-ethyl-N-(2-methanesulfonamidoethyl) aniline sesquisulfate hydrate for which the maximum absorption of the dye upon spin coating is in the range from 520 to 590 nm and the left bandwidth (LBW) or the right bandwidth (RBW) using spin-coating, is at least 5 nm less than that of the same dye in solution form;

$R_1$ is a heterocyclic, carbocyclic, or alkenyl group with substituents of sufficient electron withdrawing capacity to obtain a spin-coated dye as described in the preceding subparagraph that exhibits a maximum absorption in the range of 520–590 nm;

Y is H or a coupling-off group;

each Z* is an independently selected substituent group where p is independently 0 to 2;

$R_2$ is a heterocyclic or carbocyclic ring group, or an alkyl group;

provided that when $R_2$ is an alkyl group with an α-alkyl substituent, said α-alkyl substituent is unbranched; and provided further that the combined sum of the aliphatic carbon atoms in $R_1$, $R_2$ and all Z* is at least 8.

The invention also provides a coupler of formula (I) and an imaging method employing the element. The magenta dye formed in the element exhibits an advantageous dye hue in having reduced levels of unwanted absorption on either or both, the short wavelength or long wavelength sides, of the spectrum and the magenta coupler of the invention exhibits advantageous solubility in photographic coupler solvents.

DETAILED DESCRIPTION OF THE INVENTION

The invention may be generally described as summarized above. The coupler is an "NB magenta coupler" which is a narrow bandwidth coupler of formula (I) having substituents so that the maximum absorption of the dye upon spin coating is in the range from 520 to 590 nm and there is a reduction in the left or right bandwidths, or in both, upon spin-coating versus solution form of at least 5 nm. In accordance with the procedure, a dye is formed by combining the coupler and the developer 4-amino-3-methyl-N-ethyl-N-(2-methanesulfonamidoethyl) aniline sesquisulfate hydrate. If the left bandwidth (LBW) or the right bandwidth (RBW) of its absorption spectrum upon "spin coating" a 3% w/v solution of the dye in ethyl acetate or other suitable solvent with 3% w/v of di-n-butyl sebacate coupler solvent is at least 5 nm less than the LBW or the RBW for a solution of the same dye in acetonitrile, then the coupler is an "NB magenta coupler". The LBW of the spectral curve for a dye is the distance between the left side of the spectral curve and the wavelength of maximum absorption measured at a density of half the maximum. The RBW of the spectral curve is the distance between the wavelength of maximum absorption and the right side of the spectral curve measured at a density of half the maximum.

Although the specific developer identified above is used for the NB magenta coupler determination, it is understood that the effect with this developer is predictive and that the element and the couplers useful in the invention may be processed with any color developer such as the conventional p-phenylene diamine developers.

The "spin coating" sample is prepared by first preparing a 3% w/v solution of the dye in ethyl acetate or other suitable solvent with 3% w/v of di-n-butyl sebacate coupler solvent. If the dye is insoluble, dissolution is achieved by the addition of methylene chloride or tetrahydrofuran. The solution is filtered and 0.1–0.2 ml is applied to a clear polyethylene terephthalate support (approximately 4 cm×4 cm) and spun at 4,000 RPM using the Spin Coating equipment, Model No. EC101, available from Headway Research Inc., Garland Tex. The transmission spectra of the so prepared dye samples are then recorded.

Preferred "NB magenta couplers" form a dye which has a LBW or a RBW of the absorption spectra upon "spin coating" a sample of the dye in di-n-butyl sebacate at least 5 nm, preferably at least 10 nm, 15 nm or 20 nm, but can fall in the range of between 5 to 40 nm less than that of the same dye in acetonitrile solution.

As used herein the term "soluble" with reference to a coupler means that the coupler has a low tendency to crystallize out of the dispersion during 7 day aging and desirably for a further extended period of 48 hours at 45° C.

The following limitations apply to formulae (I)–(IX) as appropriate:

Y is H or a coupling-off group. Coupling-off groups are more fully described hereinafter. Typically, Y is H, halogen such as chloro, aryloxy such as phenoxy, or alkoxy or a heterocyclic group such as those described below. Y can also be a photographically useful coupling off group or PUG, useful for the release of chemical fragments to modify the photographic image, such as development inhibitors, bleach accelerators and the like. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, and color correction $R_1$ is a heterocyclic, carbocyclic, or alkenyl group with substituents of sufficient electron withdrawing capacity to obtain a spin-coated dye as described in the preceding paragraph that exhibits a maximum absorption in the range of 520–590 nm. $R_2$ is an aryl, heterocyclic, or alkyl group. When $R_2$ is an alkyl group with an α-alkyl substituent, said α-alkyl substituent is unbranched. Desirably, $R_1$ is an aryl group with electron withdrawing groups having a sum total of Hammett Sigma values greater than 0.8. Hammett Sigma values may be found in C. Hansch and A. J. Leo, *Substituent Constants for Correlation Analysis in Chemistry and Biology*, Wiley, New York, N.Y. (1979). Examples of groups suitable for $R_1$ or $W_1$ are chloro, fluoro, cyano, carboalkoxy, acyl, sulfonyl and trifluoromethyl, and can be the same or a mix of different groups, provided that the sum total of the Hammett Sigma values is greater than 0.8. When $R_1$ or $W_1$ is a heterocyclic group the heteroatom or atoms comprising the heterocyclic group can also be regarded as electron withdrawing groups contributing to the Hammett Sigma values.

Each $Z_1$, $Z_2$, $Z_3$ and Z* is an independently selected substituent group where p is 0 to 2. Suitable substituent groups are more fully described hereinafter. Typically p is 0. $Z_1$, $Z_2$, $Z_3$, and Z* may be any substituent and, for example, may be independently selected from hydrogen, acyl, acyloxy, alkenyl, alkyl, alkoxy, amino, mono and di-substituted amino, aryl, aryloxy, carbamoyl, carbamate, carbonamido, carboxy, carboalkoxy, cyano, halogen, heterocyclic, hydroxy, nitro, oxycarbonyl, oxysulfonyl, sulfamoyl, sulfonamido, sulfonyl, sulfoxide, thio and ureido groups. Convenient substituents are hydrogen, acyl, acyloxy, alkenyl, alkyl, alkoxy, halogen, oxycarbonyl, carbonamido, carboxy, carboalkoxy, cyano, sulfonyl and sulfoxide groups. Additionally, $Z_1$ and $Z_2$, or $Z_2$ and $Z_3$ can join to form a ring. When $Z_1$ and $Z_2$ join to form a ring, the ring can be an aromatic or non-aromatic carbocyclic ring or heterocyclic ring. When $Z_2$ and $Z_3$ join to form a ring, the ring can be carbocyclic or heterocyclic. When $Z_1$, $Z_2$, or $Z_3$ is alkenyl, the alkenyl group(s) can be further substituted with the aforementioned substituents, $Z_1'$, $Z_2'$, and $Z_3'$, including additional alkenyl groups leading to couplers with conjugated double bonds. The substituents of the additional alkenyl group, $Z_1'$ and $Z_2'$, or $Z_2'$ and $Z_3'$ can also join to form a carbocyclic or heterocyclic ring. Since structures of the invention involve a double bond(s) at the 2-position, it should be realized that geometrical isomerism is possible with certain combinations of $Z_1$, $Z_2$ and $Z_3$ or $Z_1'$, $Z_2'$, and $Z_3'$. That is, cis(Z) and trans(E) isomers are possible with certain combinations of $Z_1$, $Z_2$ and $Z_3$ or $Z_1'$, $Z_2'$, and $Z_3'$. The total combined sum of the aliphatic carbon atoms in $W_1$, $R_1$, $R_2$, $Z_1$, $Z_2$, $Z_3$, $Z_1'$, $Z_2'$, $Z_3'$ and all Z* groups is at least 8.

$W_1$ independently represent the atoms necessary to form a carbocyclic or heterocyclic ring group. Examples of suitable carbocyclic rings include cyclohexyl, phenyl and naphthyl with phenyl rings being most conveniently used. Suitable heterocyclic rings include those containing 5 or 6 ring members and at least one ring heteroatom. Heterocycles useful herein may be aromatic or non-aromatic and contain at least one atom of oxygen, nitrogen, sulfur, selenium, or tellurium. They can be fused with a carbocyclic ring or with another heterocycle. They can be attached to the coupler through any of the possible points of attachment on the heterocycle. It should be realized that multiple points of attachment are possible giving rise to alternative isomers for a single heterocycle. Examples of useful heterocyclic groups are benzimidazolyl, benzoselenazolyl, benzothiazolyl, benzoxazolyl, chromonyl, furyl, imidazolyl, indazolyl, indolyl, isoquinolyl, isothiazolyl, isoxazolyl, morpholinyl, oxadiazolyl, oxazolyl, picolinyl, piperidinyl, purinyl, pyradazinyl, pyranyl, pyrazinyl, pyrazolyl, pyridyl, pyrimidinyl, pyrrolyl, pyrrolidinyl, quinaldinyl, quinazolinyl, quinolyl, quinoxalinyl, selenazoyl, tellurazolyl, tetrazolyl, tetrahydrofuryl, thiadiazolyl, thiamorpholinyl, thiatriazolyl, thiazolyl, thienyl, thiophenyl, and triazolyl groups. A particularly useful heterocyclic group is pyridyl in which the nitrogen of the heterocyclic ring may be either ortho, meta or para to the carbonyl group of the 5-carbonamide of the coupler.

In one embodiment the coupler of formula (I) is represented by formula (II):

(II)

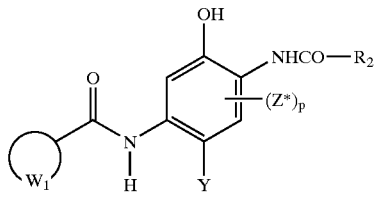

wherein:

$W_1$ represents the atoms necessary to complete carbocyclic ring group with electron withdrawing groups having a sum total of Hammett Sigma values greater than 0.8;

Y is hydrogen or a coupling off group;

each Z* is an independently selected substituent group where p is independently 0 to 2;

$R_2$ is a heterocyclic or carbocyclic ring group, or an alkyl group;

provided that when $R_2$ is an alkyl group with an α-alkyl substituent, said α-alkyl substituent is unbranched; and provided further that the combined sum of the aliphatic carbon atoms in $W_1$, $R_2$ and all Z* is at least 8.

A preferred embodiment of the invention when $W_1$ represents the atoms necessary to complete a carbocyclic ring is represented by formula (III):

(III)

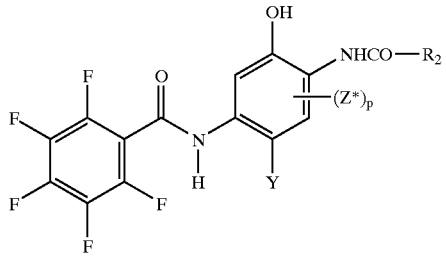

In another embodiment, the coupler of formula (II) is represented by formula (IV):

(IV)

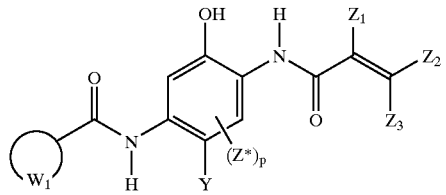

wherein:

each $Z_1$, $Z_2$ and $Z_3$ are an independently selected substituent group; and provided that the combined sum of the aliphatic carbon atoms in $W_1$, $Z_1$, $Z_2$, $Z_3$, and all Z* is at least 8.

In still further embodiments, the coupler of formula (II) is represented by formulae (V) and (VI).

(V)

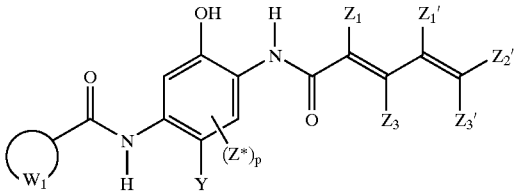

(VI)

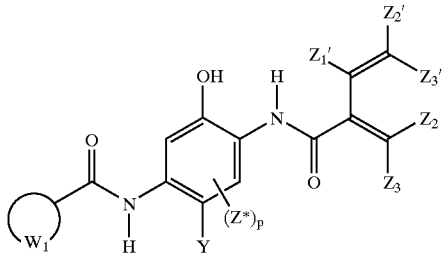

wherein:

$Z_1'$, $Z_2'$, and $Z_3'$ are independently selected substituent groups; and provided that the combined sum of the aliphatic carbon atoms in $W_1$, $Z_1$, $Z_2$, $Z_3$, $Z_1'$, $Z_2'$, and $Z_3'$ and all Z* is at least 8.

Examples of suitable heterocycles for $W_1$ are those based on a benzimidazole, benzotriazole, furan, imidazole, indazole, indole, isoquinoline, purine, pyrazole, pyridine, pyrimidine, pyrrole, quinoline, thiophene, 1,2,3-triazole, or 1,2,4-triazole ring group. Conveniently useful are the nitrogen-containing rings such as pyridine with the nitrogen in the 2-, 3-, or 4-position, as well as the various pyrimidine or pyrazole alternatives, as shown in the following coupler formulae (VII)–(IX):

(VII)

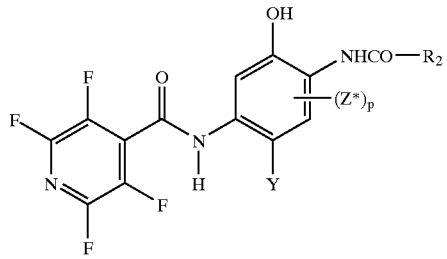

(VIII)

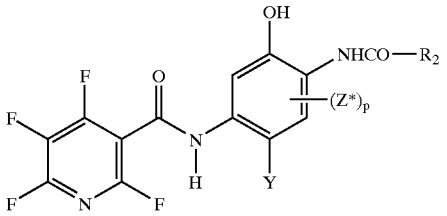

(IX)

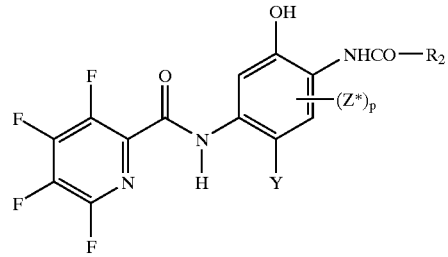

The following are examples of couplers useful in the invention:

IC-1

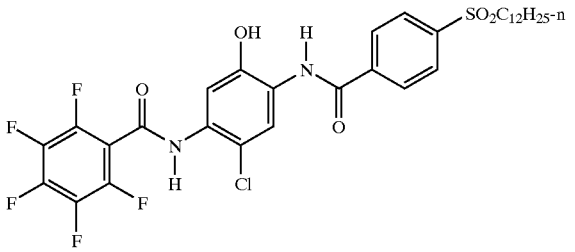

IC-2

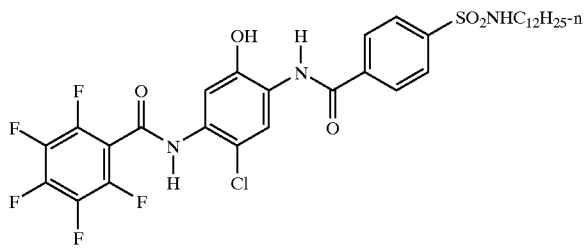

-continued
IC-3
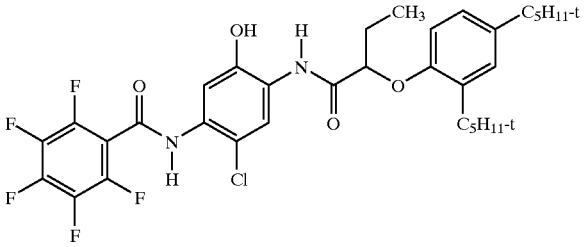
IC-4
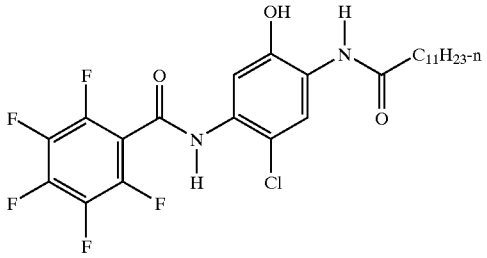
IC-5
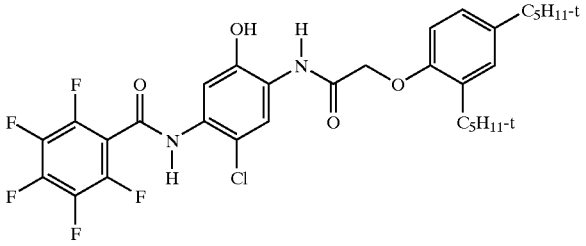
IC-6
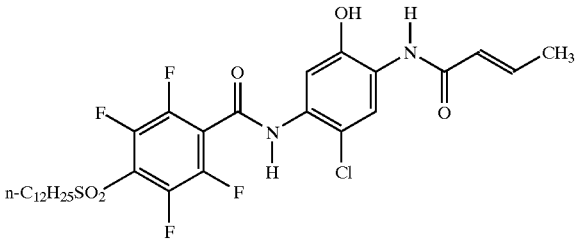
IC-7
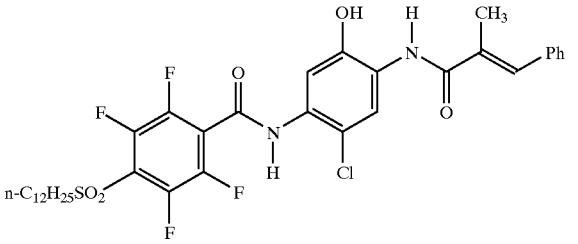
IC-8
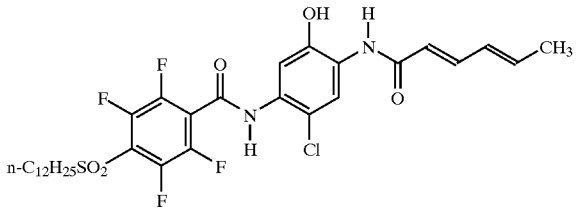
-continued
IC-9
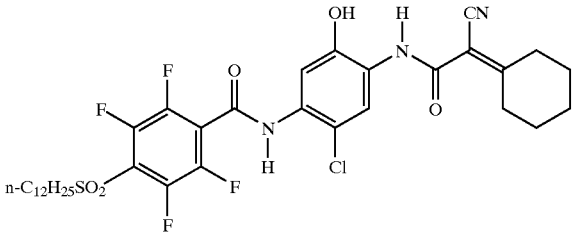
IC-10
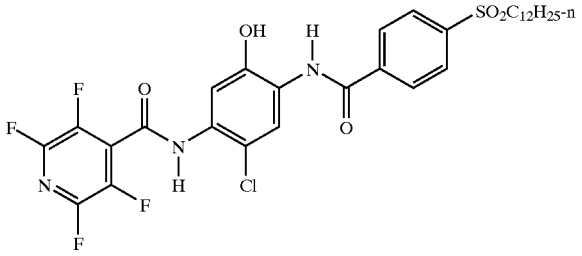
IC-11
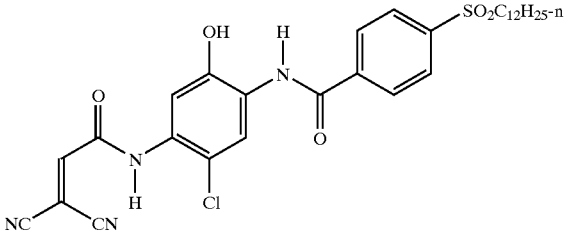
IC-12
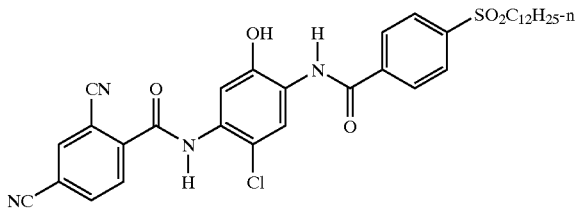
IC-13
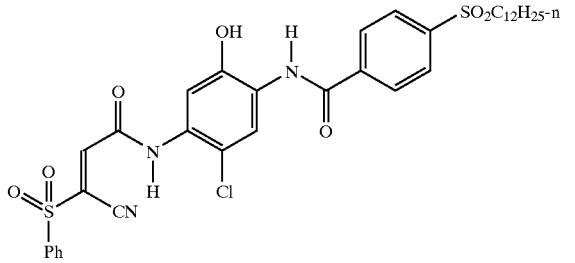

IC-14
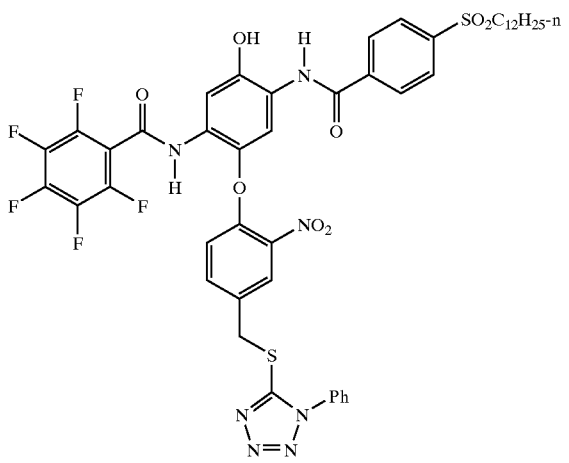
IC-15
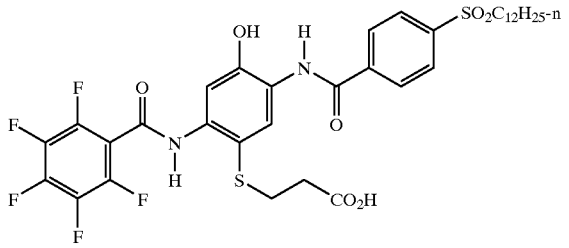
IC-16
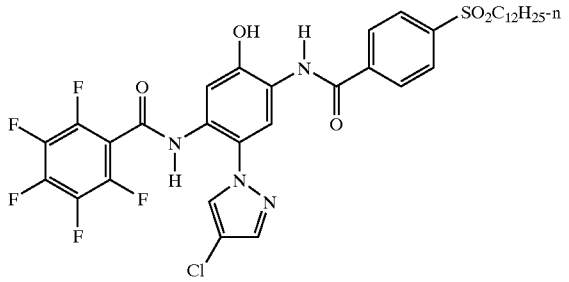
IC-17
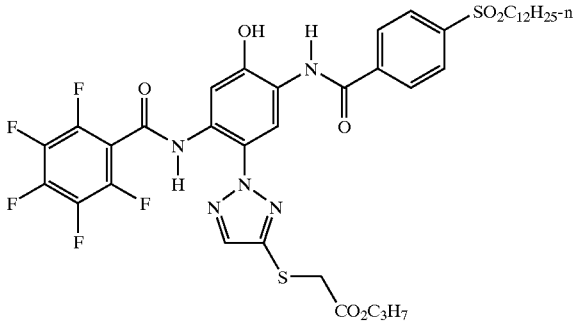
IC-18
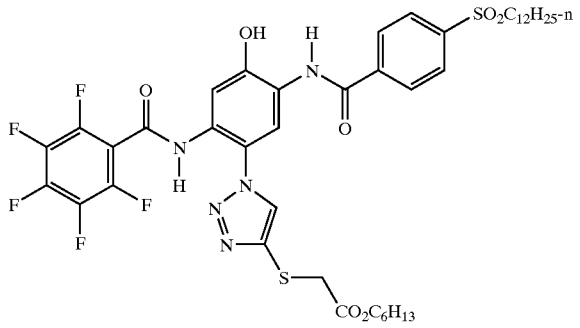
IC-19
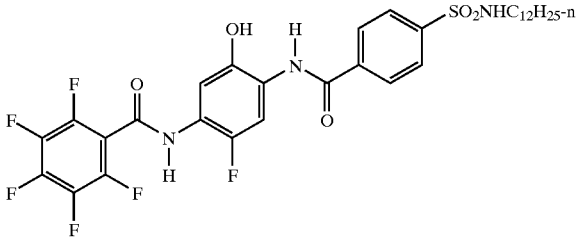
IC-20
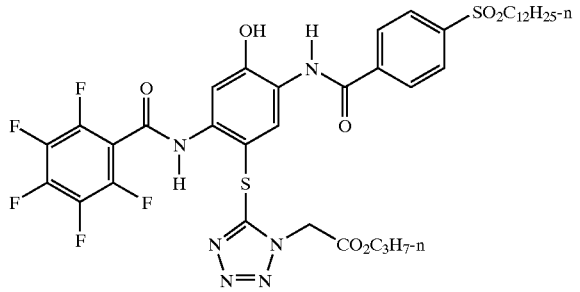
IC-21
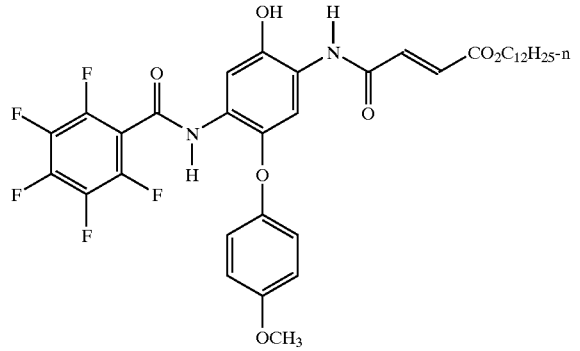

-continued

IC-22

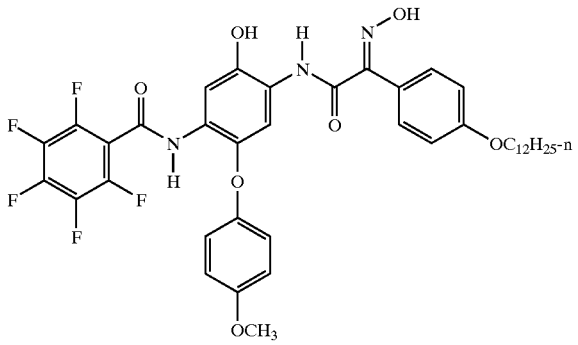

IC-23

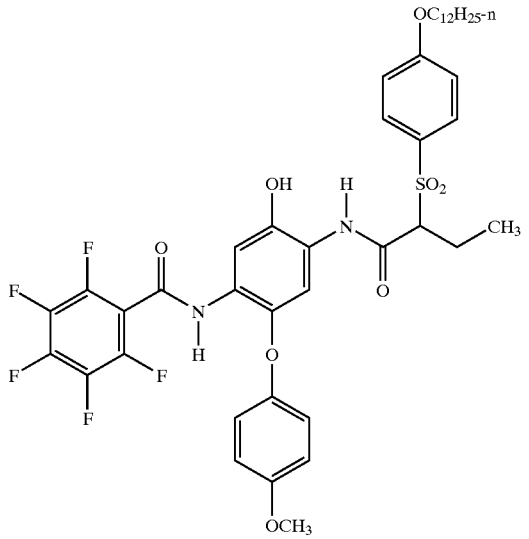

The preferred couplers useful in the invention are capable of forming dyes with color developers such as 4-amino-3-methyl-N-ethyl-N-(2-methanesulfonamidoethyl) aniline sesquisulfate hydrate that have a LBW or RBW less than 70 nm and preferably less than 60 nm. The wavelength of maximum absorption is suitably less than 580 nm and is typically less than 560 nm.

The coupler of the invention is preferably an "NB magenta coupler" which is a narrow bandwidth coupler of formula (I) having substituents so that there is a reduction in the left or right bandwidth in spin-coating form versus solution form of at least 5 nm. In accordance with the procedure, a dye is formed by combining the coupler and the developer 4-amino-3-methyl-N-ethyl-N-(2-methanesulfonamidoethyl) aniline sesquisulfate hydrate. If either the left bandwidth (LBW), right bandwidth (RBW) or both, of their absorption spectra upon "spin coating" a 3% w/v solution of the dye in di-n-butyl sebacate solvent is at least 5 nm less than the LBW, RBW or both for a solution of the same dye in acetonitrile, then the coupler is an "NB magenta coupler". The LBW of the spectral curve for a dye is the distance between the left side of the spectral curve and the wavelength of maximum absorption measured at a density of half the maximum. The RBW is the distance between the wavelength of maximum absorption and the right side of the spectral curve measured at a density of half the maximum.

The "spin coating" sample is prepared by first preparing a 3% w/v solution of the dye in ethyl acetate or other suitable solvent with 3% w/v of di-n-butyl sebacate coupler solvent. If the dye is insoluble, dissolution is achieved by the addition of methylene chloride or tetrahydrofuran. The solution is filtered and 0.1–0.2 ml is applied to a clear polyethylene terephthalate support (approximately 4 cm×4 cm) and spun at 4,000 RPM using the Spin Coating equipment, Model No. EC101available from Headway Research Inc., Garland Tex. The transmission spectra of the so prepared dye samples are then recorded.

Preferred "NB magenta couplers" form a dye which has either a LBW, RBW or both, of the absorption spectra upon "spin coating" a sample of the dye in di-n-butyl sebacate at least 5 nm, preferably at least 10 nm, 15 nm or 20 nm, but can fall in the range of between 5 to 40 nm less than that of the same dye in acetonitrile solution.

Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecyl amino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, and releasing or releasable groups. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a melt and coated as a layer described herein on a support to form part of a photographic element. When the term "associated" is employed, it signifies that a reactive compound is in or adjacent to a specified layer where, during processing, it is capable of reacting with other components.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbanoyl, alkylsulfonyl, arylsulfonyl, sulfonamido, and sulfamoyl groups wherein the substituents typically contain 1 to 42 carbon atoms. Such substituents can also be furter substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, and subbing layers.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure*, Item No. 36544 referenced above, is updated in the September 1996 *Research Disclosure*, Item No. 38957. Certain desirable photographic elements and processing steps, including those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, and color correction. When the coupling-off group has an advantageous affect on the layer in which it is released or in an adjacent layer, it is also known as a photographically useful group or PUG. The PUG can be attached to the coupler directly, or it can be attached through a linking or timing group. More detailed descriptions of PUGs, linking groups and timing groups useful for Y in formula (I) are described below under materials which release PUGs in association with materials of the invention.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers in addition to those of the invention may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. Nos. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474;. 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Pat. No. 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

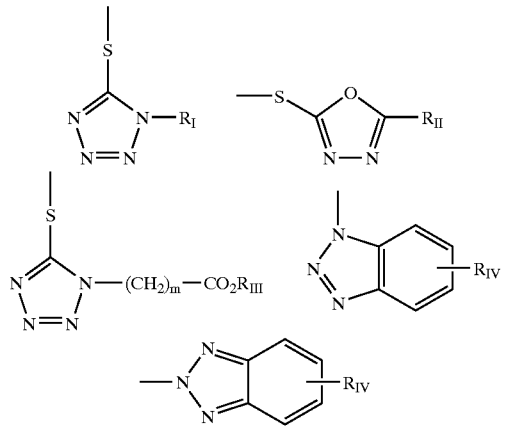

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

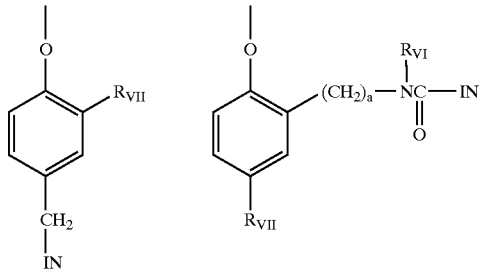

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

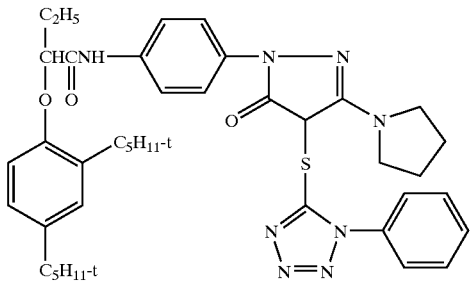

D2

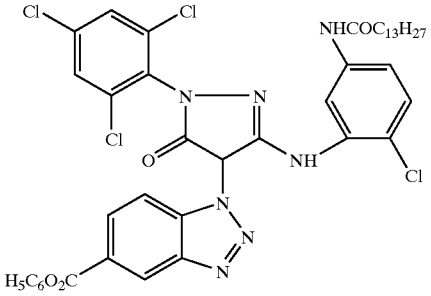

D3

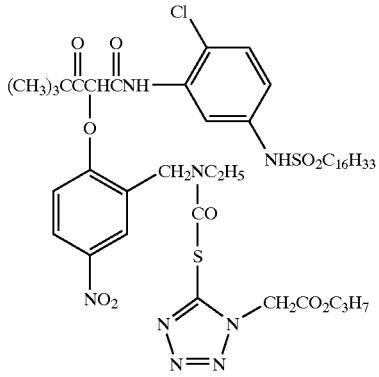

D4

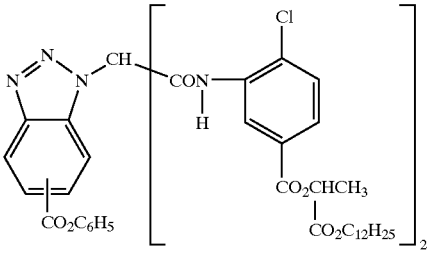

D5

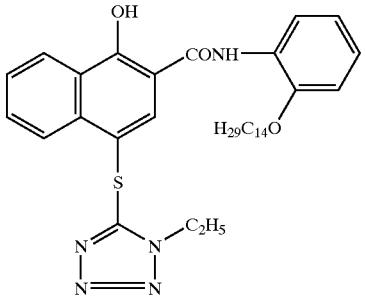

-continued

D6

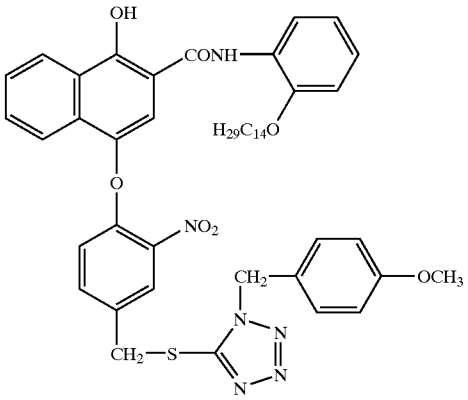

D7

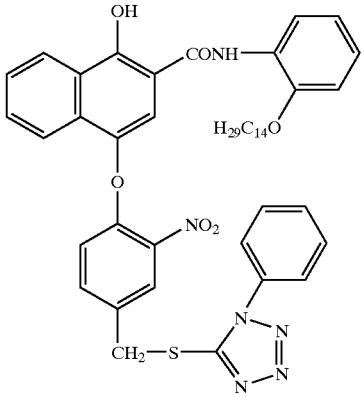

D8

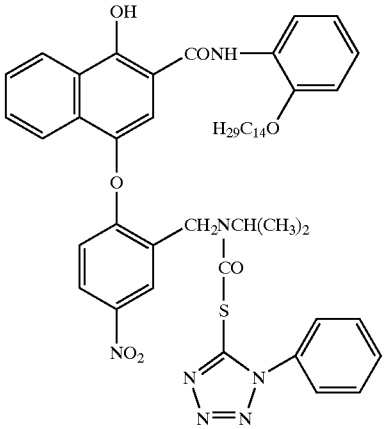

D9

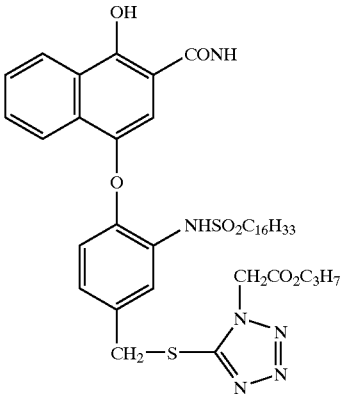

-continued

D10

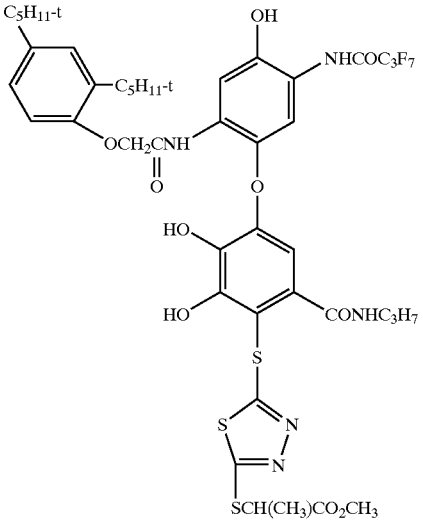

D11

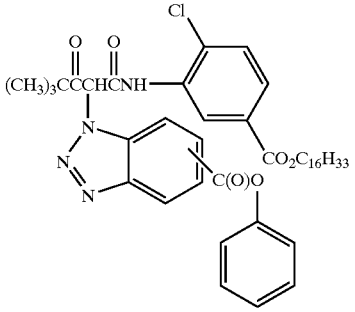

D12

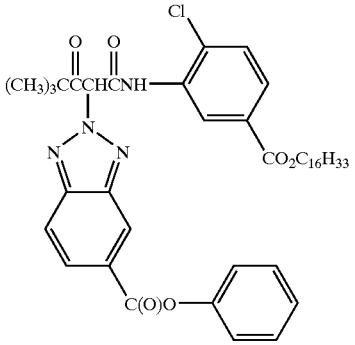

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Conventional radiation-sensitive silver halide emulsions can be employed in the practice of this invention. Such emulsions are illustrated by *Research Disclosure*, Item 38755, September 1996, I. Emulsion grains and their preparation.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. Pat. No. 4,439,520, Wilgus et al U.S. Pat. No. Pat. No. 4,434,226, Solberg et al U.S. Pat. No. 4,433,048, Maskasky U.S. Pat. No. Pat. Nos. 4,435,501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye. If desired "Redox Amplification" as described in Research Disclosure XVIIIB(5) may be used.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

Another type of color negative element is a color print. Such an element is designed to receive an image optically printed from an image capture color negative element. A color print element may be provided on a reflective support for reflective viewing (e.g. a snap shot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold packaged with instructions to process using a color negative optical printing process, for example the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal elements are typically sold packaged with instructions to process using a color reversal process such as the Kodak E-6 process as described in The British Journal of Photography Annual of 1988, page 194. Alternatively, a direct positive emulsion can be employed to obtain a positive image.

The above elements are typically sold with instructions to process using the appropriate method such as the mentioned color negative (Kodak C-41), color print (Kodak RA-4), or reversal (Kodak E-6) process.

Preferred color developing agents are p-phenylenediamines such as:

- 4-amino-N,N-diethylaniline hydrochloride,
- 4-amino-3-methyl-N,N-diethylaniline hydrochloride,
- 4-amino-3-methyl-N-ethyl-N-(2-methanesulfonamidoethyl)aniline sesquisulfate hydrate,
- 4-amino-3-methyl-N-ethyl-N-(2-hydroxyethyl)aniline sulfate,
- 4-amino-3-(2-methanesulfonamidoethyl)-N,N-diethylaniline hydrochloride, and
- 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying The compound of the invention is a coupler compound as described in the foregoing description of the photographic element. The process of the invention includes a method of forming an image in the described silver halide element after the same has been exposed to light comprising contacting the exposed element with a color developing compound such as a para phenylene diamine.

A direct-view photographic element is defined as one which yields a color image that is designed to be viewed directly (1) by reflected light, such as a photographic paper print, (2) by transmitted light, such as a display transparency, or (3) by projection, such as a color slide or a motion picture print. These direct-view elements may be exposed and processed in a variety of ways. For example, paper prints, display transparencies, and motion picture prints are typically produced by optically printing an image from a color negative onto the direct-viewing element and processing though an appropriate negative-working photographic process to give a positive color image. Color slides may be produced in a similar manner but are more typically produced by exposing the film directly in a camera and processing through a reversal color process or a direct positive process to give a positive color image. The image may also be produced by alternative processes such as digital printing.

Each of these types of photographic elements has its own particular requirements for dye hue, but in general they all require cyan dyes that whose absorption bands are less deeply absorbing (that is, shifted away from the red end of the spectrum) than color negative films. This is because dyes in direct viewing elements are selected to have the best appearance when viewed by human eyes, whereas the dyes in color negative materials designed for optical printing are designed to best match the spectral sensitivities of the print materials.

The compound of the invention is the coupler compound as described in the foregoing description of the photographic element. The process of the invention includes a method of forming an image in the described silver halide element after the same has been exposed to light comprising contacting the exposed element with a color developing compound such as a para phenylene diamine.

SYNTHESIS EXAMPLE

The following is an example of how couplers useful in the invention may be synthesized:

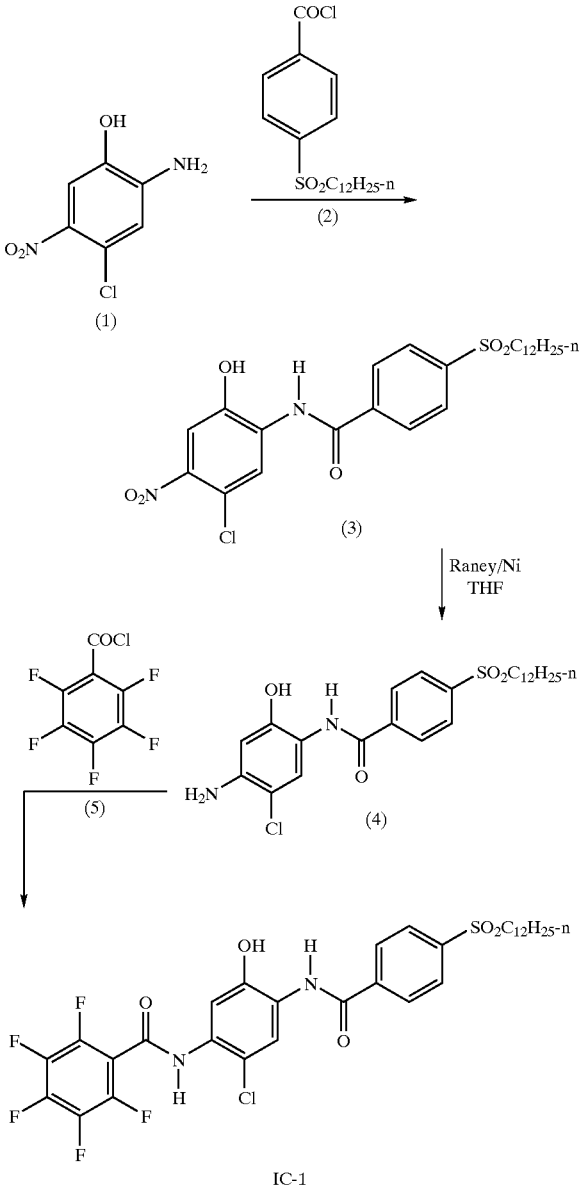

4-Dodecylsulfonylbenzoyl Chloride (2)

4-Dodecylsulfonylbenzoic acid (25.45 g, 71.8 mMole) was added to thionyl chloride (100 mL) together with 2 drops of dirnethylformarnide. The resulting mixture was heated to 60° C. for 3 hours. The solution was then cooled, concentrated under reduced pressure and co-evaporated with ethyl acetate (2×50 mL). The residual solid, assuming a quantitative yield, was taken on to the next step.

Compound (3)

2-Amino-4-chloro-5-nitrophenol (1), (12.18 g, 64.62 mMole) and compound (2) (71.8 mMole), as described above, were heated in acetonitrile (250 mL) under gentle reflux for 2 hours. The dark colored solution was cooled and concentrated under reduced pressure. When crystallization of the product began, concentrating was stopped and the reaction mixture treated with additional acetonitrile (100 mL) and cooled to 4° C. for several hours. The yellow solid was filtered off, washed with a little cold acetonitrile and air-dried. Yield 28.5 g.

Compound (4)

Compound (3) (3.6 g, 6.95 mMole), was dissolved in tetrahydrofuran (100 mL), and Raney-Nickel which had been pre-washed with water (×3) and tetrahydrofuran (×3), was added. The mixture was then hydrogenated at room temperature and 352 kg/dm$^2$ (50 psi) of hydrogen. The reaction is complete in approximately 1.5 hours. After this period, the catalyst is carefully filtered off and the solution concentrated under reduced pressure. The solid residue was washed out of the flask with ether, washed with a little ether and air-dried. Yield 2.8 g.

Inventive Coupler IC-1

Compound (4), (2.0 g, 4.04 mMole) was dissolved in tetrahydrofuran (30 mL), and dry pyridine (0.36 mL, 4.44 mMole) added. The solution was cooled in an ice bath while 2,3,4,5,6-pentafluorobenzoyl chloride (5), (0.64 mL, 4.44 mMole) in ethyl acetate (5 mL) was added drop by drop. At the end of the addition, the cooling bath was removed and the reaction mixture allowed to warm to room temperature. After 15 minutes the reaction was diluted with ethyl acetate, washed with 2N-HCl (2×50 mL), dried ($MgSO_4$), and concentrated under reduced pressure. Before all of the solvent had been removed the product began to crystallize. The residue was treated with ether and allowed to stand for several hours at room temperature. The white solid of Inventive Coupler IC-1 was filtered off, washed with a little ether and air-dried. Yield 2.5 g.

Dye Property Examples

Using procedures known to those skilled in synthetic chemistry, such as described in J. Bailey, JCS Perkin 1, 1977, 2047, the dyes of the couplers in Table 1 below were prepared by coupling with 4-amino-3-methyl-N-ethyl-N-(2-methane-sulfonamidoethyl) aniline sesquisulfate hydrate, and then purified by either crystallization or chromatographic techniques.

A 3% w/v solution of di-n-butyl sebacate was made with ethyl acetate and from this solution a 3% solution of the dye was prepared. If the dye was insoluble, dissolution was achieved by either the addition of methylene chloride or tetrahydrofuran, or tetrahydrofuran was used as the sole solvent. The solution was filtered and 0.1–0.2 mL was applied to a clear polyethylene-terephthalate support (approximately 4cm×4cm) and spun at 4,000 RPM using the Spin-Coating equipment, Model No. EC101, available from Headway Research Inc., Garland Tex. The transmission spectra of the so-prepared dye samples were then recorded. The transmission spectra of the same dye as a solution of the dye in acetonitrile was also measured for comparison purposes.

The $\lambda_{max}$ values, "half bandwidth" (HBW), "left bandwidth" (LBW) and "right bandwidth" (RBW) values for each spectrum are reported in Table 1 below.

TABLE 1

Spin Coating and Solution (acetonitrile) Data (nm).

| Coupler/ | Solution | | | | Spin Coating | | | |
|---|---|---|---|---|---|---|---|---|
| Dye | $\lambda_{max}$ | HBW | LBW | RBW | $\lambda_{max}$ | HBW | LBW | RBW |
| CC-1 | 650 | 138 | 73 | 65 | 651 | 134 | 67 | 67 |
| CC-2 | 628 | 121 | 63 | 58 | 631 | 126 | 62 | 64 |
| CC-3 | 632 | 121 | 62 | 59 | 624 | 77 | 36 | 41 |
| CC-4 | 640 | 124 | 66 | 58 | 808 | 89 | 57 | 32 |
| CC-5 | 631 | 122 | 63 | 59 | 758 | 136 | 87 | 49 |
| CC-6 | 637 | 119 | 60 | 59 | 631 | 142 | 63 | 79 |
| CM-7 | 519 | 71 | 39 | 32 | 523 | 87 | 42 | 45 |
| CM-8 | 527 | 84 | 44 | 40 | 550 | 82 | 46 | 36 |
| CM-9 | 527 | 74 | 42 | 32 | 527 | 82 | 45 | 37 |
| IC-1 | 635 | 125 | 64 | 61 | 548 | 61 | 25 | 36 |
| IC-2 | 637 | 125 | 64 | 61 | 583 | 65 | 30 | 35 |
| IC-3 | 633 | 125 | 66 | 59 | 534 | 75 | 30 | 45 |
| IC-4 | 624 | 126 | 66 | 60 | 540 | 115 | 38 | 77 |
| IC-5 | 631 | 125 | 65 | 60 | 551 | 72 | 29 | 43 |

The wavelength of maximum absorption was recorded as the $\lambda_{max}$. The half bandwidth (HBW) was obtained by subtracting the wavelength at the point where the density is half the value of the maximum density on the left side (short wavelength) of the absorption band from the wavelength at the point on the right side (long wavelength) of the absorption band where the density is half the value of the maximum density. The left bandwidth (LBW) was obtained by subtracting the wavelength at the point on the left side (short wavelength) of the absorption band where the density is half the value of the maximum density from the wavelength of maximum density. The right bandwidth (RBW) was obtained by subtracting the wavelength of maximum density from the wavelength at the point on the right side (long wavelength) of the absorption band where the density is half the value of the maximum density. The differences in $\lambda_{max}$, LBW and RBW between spin coatings and acetonitrile solutions of the dyes from the couplers are reported in Table 2.

TABLE 2

Differences in $\lambda_{max}$, LBW and RBW between Spin Coating (SC), and Acetonitrile Solution (Soln.) Data (nm).

| Dye/Coupler | $\lambda_{max}$(soln) − $\lambda_{max}$(SC)[a] | LBW(soln) − LBW(SC)[b] | RBW(soln)− RBW(SC)[b] |
|---|---|---|---|
| CC-1 | −1 | +6 | −2 |
| CC-2 | −3 | +1 | −6 |
| CC-3 | +8 | +26 | +18 |
| CC-4 | −168 | +9 | +26 |
| CC-5 | −127 | −24 | +10 |
| CC-6 | +6 | −3 | −20 |
| CM-7 | −4 | −3 | −13 |
| CM-8 | −23 | −2 | +4 |
| CM-9 | 0 | −3 | +5 |
| IC-1 | +87 | +39 | +25 |
| IC-2 | +54 | +34 | +26 |
| IC-3 | +99 | +36 | +14 |

TABLE 2-continued

Differences in $\lambda_{max}$, LBW and RBW between Spin Coating (SC), and Acetonitrile Solution (Soln.) Data (nm).

| Dye/Coupler | $\lambda_{max}$(soln) − $\lambda_{max}$(SC)[a] | LBW(soln) − LBW(SC)[b] | RBW(soln)− RBW(SC)[b] |
|---|---|---|---|
| IC-4 | +84 | +28 | −17 |
| IC-5 | +80 | +36 | +17 |

[a]A positive number in this column indicates that the $\lambda_{max}$ of the dye has shifted to shorter wavelength while a negative number indicates that it has shifted to longer wavelength, upon spin coating.
[b]A positive number in these columns indicates that the LBW or RBW has narrowed while a negative number indicates that they have broadened, upon spin coating.

Couplers CC-1, CC-2, and CC-3 are typical phenolic cyan couplers found in the photographic industry. Although phenolic couplers CC-4, CC-5 and CC-6 incorporate strong electron withdrawing groups, they do not fall under the scope of the current invention in that neither have the required sum total of Hammett Sigma values of greater than 0.8 in the $W_1$ group. Couplers CM-7, CM-8 and CM-9 are typical magenta couplers found in the photographic industry. Coupler CM-7 is a typical pyrazolone coupler, while CM-8 and CM-9 are typical pyrazolotriazole couplers. All of the dyes from the phenolic coupler group, invention and comparison, CC-1, CC-2, CC-3, CC-4, CC-5, CC-6, IC-1, IC-2, IC-3, IC-4 and IC-5 have solution $\lambda_{max}$, LBW and RBW values typical of cyan dyes, while the dyes from CM-7, CM-8 and CM-9 have typical solution values for magenta dyes.

From Table 2 it can be seen that the differences between $\lambda_{max}$ values in solution and spin-coatings are small for the typical phenolic cyan couplers CC-1, CC-2 and CC-3. Of these three couplers CC-3 shows the largest shift of +8 nm, but the dye from this coupler is still cyan, absorbing in the red region of the spectrum. A positive number indicates that upon spin coating the $\lambda_{max}$ shifts to shorter wavelength, while a negative value indicates the $\lambda_{max}$ has shifted to longer wavelength. Couplers CC4 and CC-5 are phenolic couplers with strong electron withdrawing groups, but neither have the required sum total of Hammett Sigma values of greater than 0.8 in the $W_1$ group of formula (I) of the current invention. The values are 0.74 for CC-4 and 0.8 for CC-5. Inspection of the $\lambda_{max}$ differences shows that although there is a very large shift between solution and spin-coatings, the shifts for CC-4 and CC-5 are negative, that is they are shifted in the wrong direction and are moved into the infrared part of the spectrum. Although coupler CC-6 has strong electron withdrawing groups, it does not fulfill the requirements of the current invention and does not show any significant shift to the green region of the spectrum upon spin coating. Couplers CM-7 and CM-8 are typical magenta couplers, and show only small shifts in their $\lambda_{max}$ values upon spin coating. Magenta coupler CM-9 shows no change in $\lambda_{max}$. On the other hand, couplers of the invention IC-1, IC-2, IC-3, IC-4 and IC-5 all show large positive shifts in going from solution to spin-coatings and as seen from Table 1 shift well into the green region of the spectrum with $\lambda_{max}$ values ranging from 534 nm for IC-3 to 583 nm for IC-2. In addition, as seen in Tables 1 and 2 couplers of the invention, when compared to the control couplers, give both very narrow LBW and RBW dyes in spin coatings versus their values in solution. These couplers therefore meet the criterion defined for the current invention.

CC-1
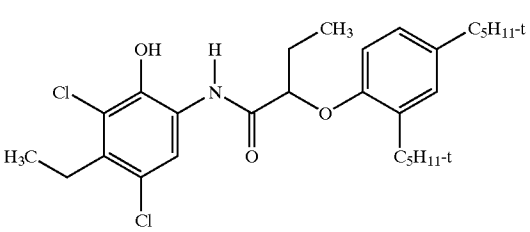
CC-2
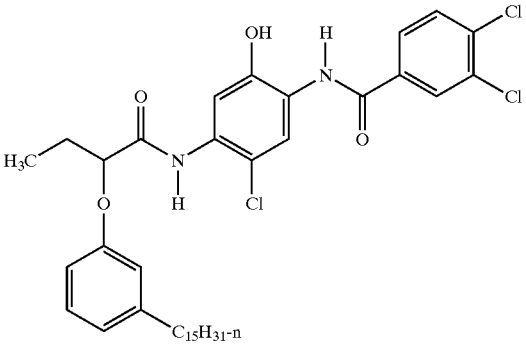
CC-3
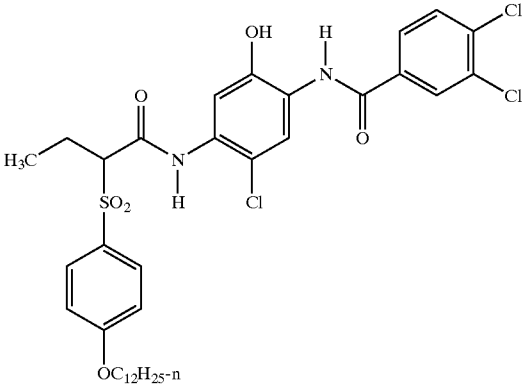
CC-4
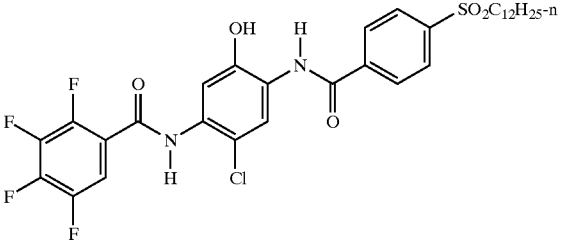
CC-5
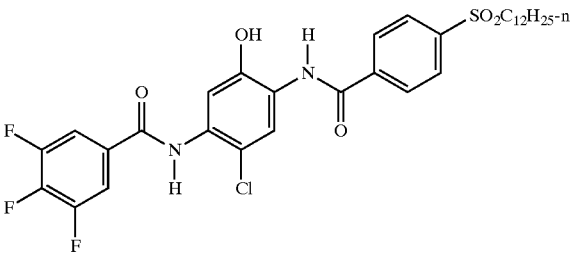
CC-6
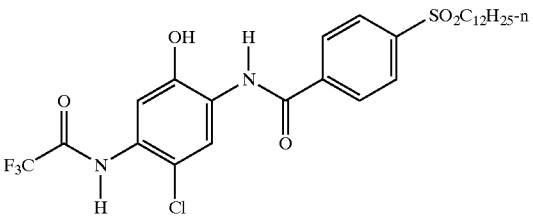

-continued
CM-7
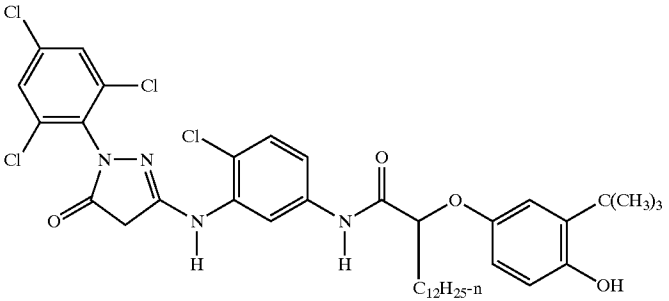
CM-8
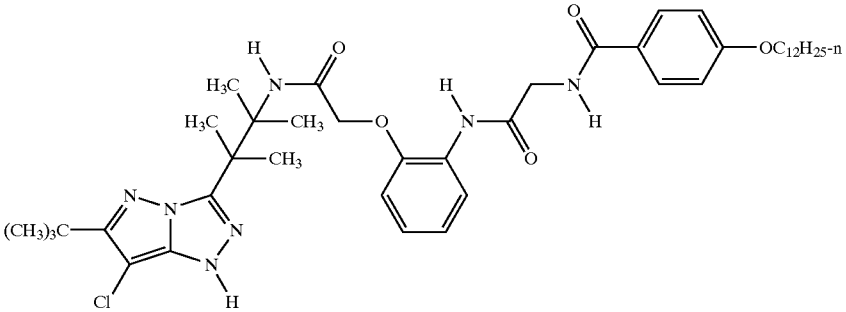
CM-9
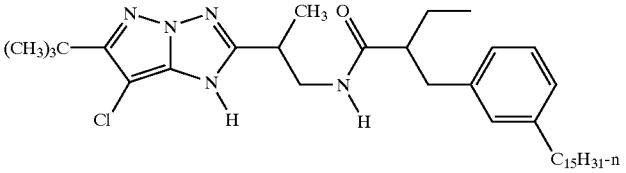

PHOTOGRAPHIC EXAMPLES

Preparation of Photographic Elements

On a gel-subbed, polyethylene-coated paper support were coated the following layers:

First Layer

An underlayer containing 3.23 grams gelatin per square meter.

Second Layer

A photosensitive layer containing (per square meter) 2.15 grams gelatin, an amount of red-sensitized silver chloride emulsion containing the amount of silver (determined by the equivalency of the coupler) indicated in Table 3; a dispersion containing $8.61\times10^{-4}$ mole of the coupler indicated in Table 3, and 0.043 gram surfactant Alkanol XC (trademark of E. I. Dupont Co.)(in addition to the Alkanol XC used to prepare the coupler dispersion). The coupler dispersion contained the coupler, all of the gelatin in the layer except that supplied by the emulsion, an amount of the coupler solvent indicated in Table 3, equal to the weight of coupler, and 0.22 gram Alkanol XC. The ultraviolet light absorber UV-1, was added in an amount equal to 1.5 molar equivalents of the inventive coupler.

Third Layer

A protective layer containing (per square meter) 1.40 grams gelatin, 0.15 gram bis(vinylsulfonyl)methane, 0.043 gram Alkanol XC, and $4.40\times10^{-6}$ gram tetraethylammonium perfluorooctanesulfonate.

The coupler solvents and components used were:

S-1

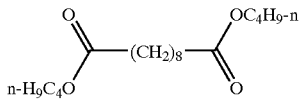

UV-1

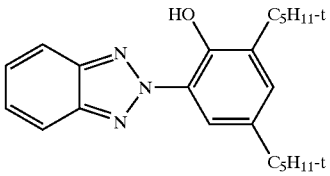

Comparison coupler CC-3, like the couplers of the invention is phenolic. It is included in the photographic examples because it is a typical phenolic cyan coupler currently used in commercially available color photographic papers and is typical of cyan couplers known in the photographic art. It is unlike the couplers of the invention because it does not have the substituents necessary to make it a phenolic "NB magenta coupler".

Preparation of Processed Photographic Examples

Processed samples were prepared by exposing the coatings through a step wedge and processing as follows:

| Process Step | Time (min.) | Temp. (° C.) |
|---|---|---|
| Developer | 0.75 | 35.0 |
| Bleach-Fix | 0.75 | 35.0 |
| Water wash | 1.50 | 35.0 |

The processing solutions used in the above process had the following compositions (amounts per liter of solution):

| Developer | |
|---|---|
| Triethanolamine | 12.41 g |
| Blankophor REU (trademark of Mobay Corp.) | 2.30 g |
| Lithium polystyrene sulfonate | 0.09 g |
| N,N-Diethylhydroxylamine | 4.59 g |
| Lithium sulfate | 2.70 g |
| Developing agent Dev-1 | 5.00 g |
| 1-Hydroxyethyl-1,1-diphosphonic acid | 0.49 g |
| Potassium carbonate, anhydrous | 21.16 g |
| Potassium chloride | 1.60 g |
| Potassium bromide | 7.00 mg |
| pH adjusted to 10.4 at 26.7° C. | |
| **Bleach-Fix** | |
| Solution of ammonium thiosulfate | 71.85 g |
| Ammonium sulfite | 5.10 g |
| Sodium metabisulfite | 10.00 g |
| Acetic acid | 10.20 g |
| Ammonium ferric ethylenediaminetetraacetate | 48.58 g |
| Ethylenediaminetetraacetic acid | 3.86 g |
| pH adjusted to 6.7 at 26.7° C. | |

Dev-1

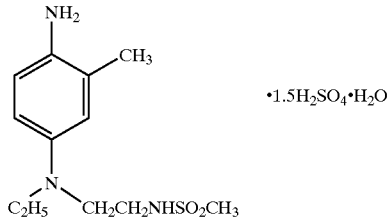

The spectra of the resulting dyes were measured and normalized to a maximum absorption of 1.00. The wavelength of maximum absorption was recorded as the $\lambda_{max}$. As can be seen from Table 3, the difference in $\lambda_{max}$ or $\lambda_{max}$, between solution and film is 93 nm for IC-1 in coupler solvent S-1 and 80 nm in coupler solvent S-2. Inventive coupler IC-1 is therefore shifted well into the green region of the electromagnetic spectrum. There is no difference between the spectra of comparison coupler CC-3 in photographic film versus solution. Phenolic couplers that give dyes on coupling with oxidized color developer with $\lambda_{max}$ values shifted into the green region of the spectrum, are highly desirable as magenta couplers and useful for incorporation into photographic layers where a magenta dye is needed.

TABLE 3

Photographic Data.

| Comparison or Invention | Coupler | Coupler Solvent | (mg/m$^2$) Ag | $\lambda_{max}$ (Film) (nm) | $\lambda_{max}$ (Soln.) (nm) | $\Delta\lambda_{max}$ (Soln − Film) (nm) | LBW (nm) |
|---|---|---|---|---|---|---|---|
| Comparison | CC-3 | S-1 | 17 | 632 | 632 | 0 | 45 |
| Invention | IC-1 | S-1 | 17 | 542 | 635 | 93 | 38 |
| Invention | IC-1 | S-2 | 17 | 555 | 635 | 80 | 44 |

The data in Tables 1, 2 and 3 shows that all of the phenolic couplers of the present invention form dyes in both spin coatings and film that are shifted into the green region of the spectrum.

The entire contents of the various patents and other publications referred to in this specification are incorporated herein by reference.

What is claimed is:

1. A photographic element comprising a light-sensitive silver halide emulsion layer having associated therewith a phenolic "NB magenta coupler" having the formula:

(I)

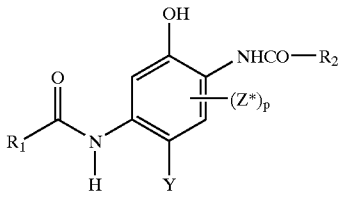

wherein:

the term "NB magenta coupler" represents a coupler of formula (I) that forms a magenta dye with the developer 4-amino-3-methyl-N-ethyl-N-(2-methanesulfonamidoethyl) aniline sesquisulfate hydrate for which the maximum absorption of the dye upon spin coating is in the range from 520 to 590 nm and the left bandwidth (LBW) or the right bandwidth (RBW) using spin-coating, is at least 5 nm less than that of the same dye in solution form;

$R_1$ is a heterocyclic, carbocyclic, or alkenyl group with substituents of sufficient electron withdrawing capacity to obtain a spin-coated dye as described in the preceding subparagraph that exhibits a maximum absorption in the range of 520–590 nm;

Y is H or a coupling-off group;

each Z* is an independently selected substituent group where p is independently 0 to 2;

$R_2$ is a heterocyclic or carbocyclic ring group, or an alkyl group;

provided that when $R_2$ is an alkyl group with an α-alkyl substituent, said α-alkyl substituent is unbranched; and provided further that the combined sum of the aliphatic carbon atoms in $R_1$, $R_2$ and all Z* is at least 8.

2. The element of claim 1 wherein the coupler is represented by formula (II):

(II)

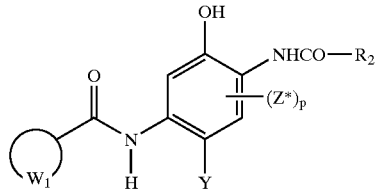

wherein:

$W_1$ represents the atoms necessary to complete an aryl group with electron withdrawing groups having a sum total of Hammett Sigma values greater than 0.8;

Y is hydrogen or a coupling off group;

each Z* is an independently selected substituent group where p is independently 0 to 2;

$R_2$ is a heterocyclic or carbocyclic ring group, or an alkyl group;

provided that when $R_2$ is an alkyl group with an α-alkyl substituent, said α-alkyl substituent is unbranched; and provided further that the combined sum of the aliphatic carbon atoms in $W_1$, $R_2$ and all Z* is at least 8.

3. The element of claim 2 wherein the coupler is represented by formula (III):

(III).

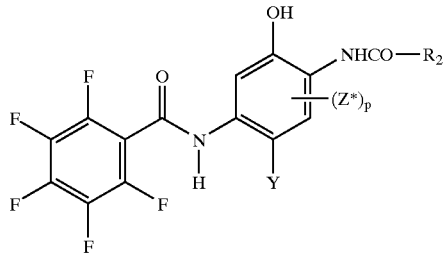

4. The element of claim 2 wherein the coupler is represented by formula (IV):

(IV)

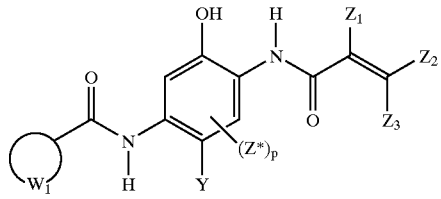

wherein:

each $Z_1$, $Z_2$ and $Z_3$ are an independently selected substituent group; and provided that the combined sum of the aliphatic carbon atoms in $W_1$, $Z_1$, $Z_2$, $Z_3$, and all Z* is at least 8.

5. The element of claim 2 wherein the coupler is represented by formulae (V) and II):

(V)

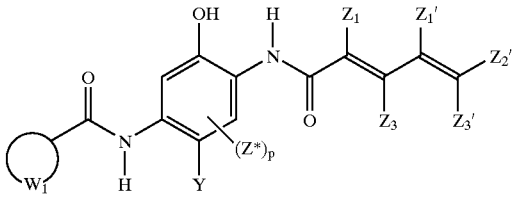

(VI)

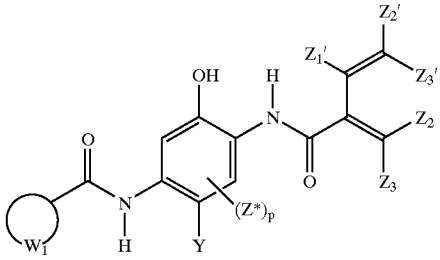

wherein:

$Z_1'$, $Z_2'$, and $Z_3'$ are independently selected substituent groups; and provided that the combined sum of the aliphatic carbon atoms in $W_1$, $Z_1$, $Z_2$, $Z_3$, $Z_1'$, $Z_2'$, and $Z_3'$ and all Z* is at least 8.

6. The element of claim 1 wherein $W_1$ represents the atoms necessary to form a pyridine ring represented by formulae (VII)–(IX):

(VII)

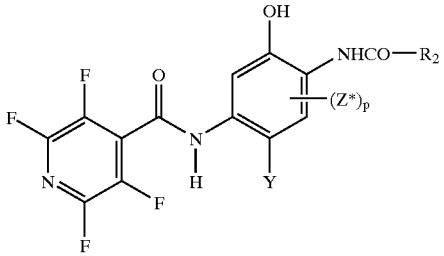

(VIII)

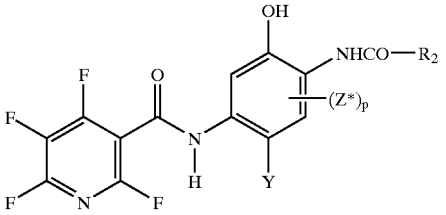

(IX).

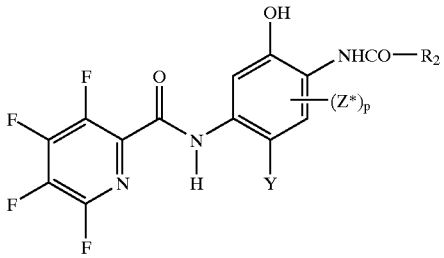

7. The element of claim 1 wherein $R_1$ is a heterocycle selected from the group consisting of benzimidazolyl, benzoselenazolyl, benzothiazolyl, benzoxazolyl, chromonyl, furyl, imidazolyl, indazolyl, indolyl, isoquinolyl, isothiazolyl, isoxazolyl, morpholinyl, oxadiazolyl, oxazolyl, picolinyl, piperidinyl, purinyl, pyradazinyl, pyranyl, pyrazinyl, pyrazolyl, pyridyl, pyrimidinyl, pyrrolyl, pyrrolidinyl, quinaldinyl, quinazolinyl, quinolyl, quinoxalinyl, selenazoyl, tellurazolyl, tetrazolyl, tetrahydrofuryl, thiadiazolyl, thiamorpholinyl, thiatriazolyl, thiazolyl, thienyl, thiophenyl, and triazolyl groups.

8. The element of claim 1 wherein $R_1$ comprises one or more substituent groups selected from chloro, fluoro, cyano, carboalkoxy, acyl, sulfonyl and trifluoromethyl.

9. The element of claim 4 wherein each $Z_1$, $Z_2$, $Z_3$ and Z* is independently selected from hydrogen, acyl, acyloxy, alkenyl, alkyl, alkoxy, amino, mono and di-substituted amino, aryl, aryloxy, carbamoyl, carbamate, carbonamido, carboxy, carboalkoxy, cyano, halogen, heterocyclic, hydroxy, nitro, oxycarbonyl, oxysulfonyl, sulfamoyl, sulfonamido, sulfonyl, sulfoxide, thio, and ureido groups.

10. The element of claim 4 wherein each $Z_1$, $Z_2$ and $Z_3$ is independently selected from hydrogen, alkyl, aryl, carboalkoxy and cyano groups.

11. The element of claim 4 wherein $Z_2$ and $Z_3$ join to form a carbocyclic ring and $Z_1$ is selected from hydrogen, alkyl, aryl, carboalkoxy and cyano groups.

12. The element of claim 5 wherein each $Z_1$, $Z_2$, $Z_3$, $Z_1'$, $Z_2'$, and $Z_3'$ is independently selected from hydrogen, alkyl, aryl, carboalkoxy and cyano groups.

13. A photographic element in accordance with claim 1 wherein the photographic coupler is selected from the following:

IC-1

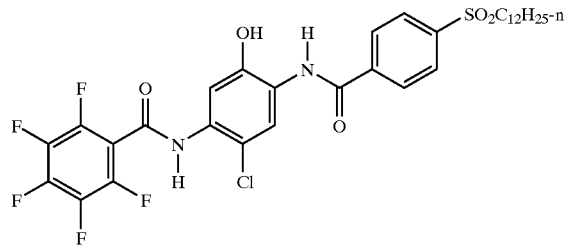

IC-2

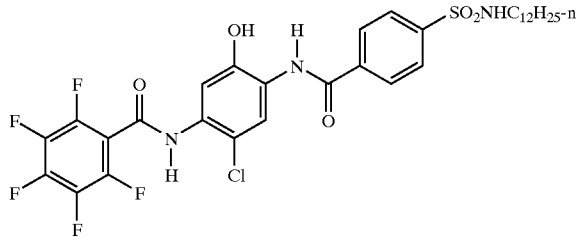

IC-3

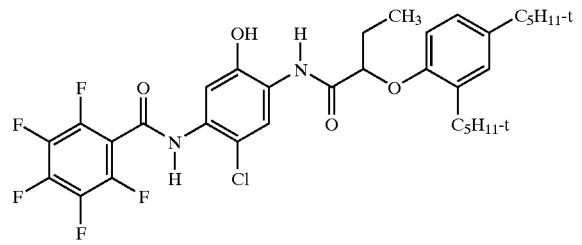

-continued
IC-4
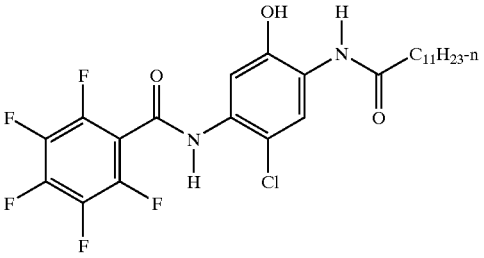
IC-5
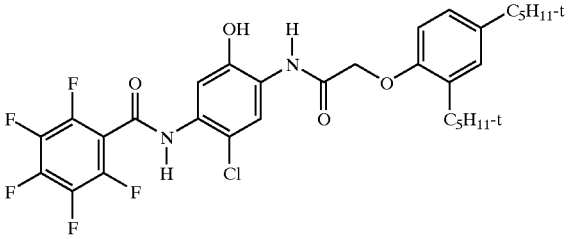
IC-6
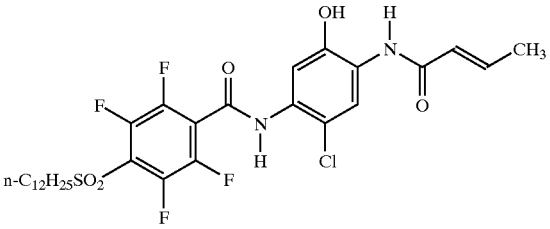
IC-7
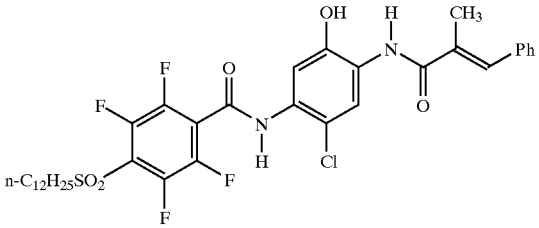
IC-8
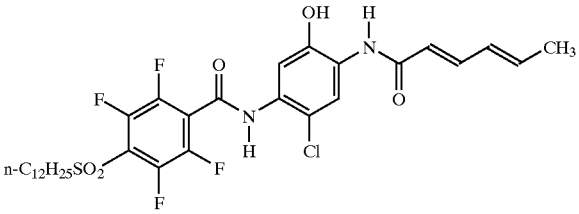
IC-9
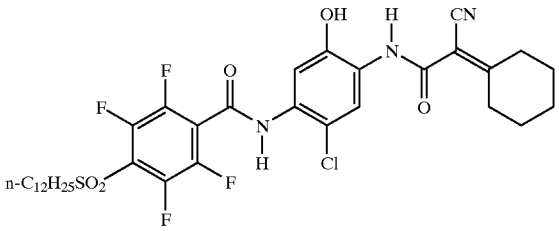
-continued
IC-10
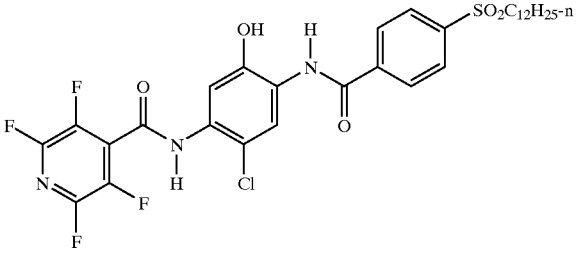
IC-11
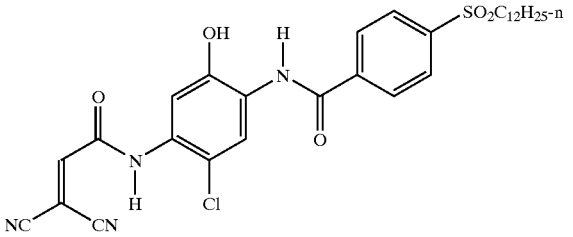
IC-12
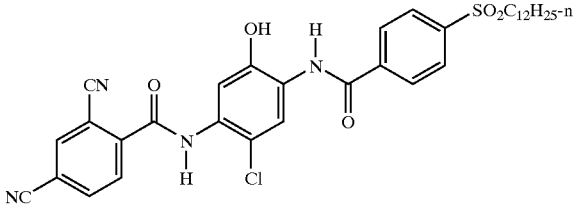
IC-13
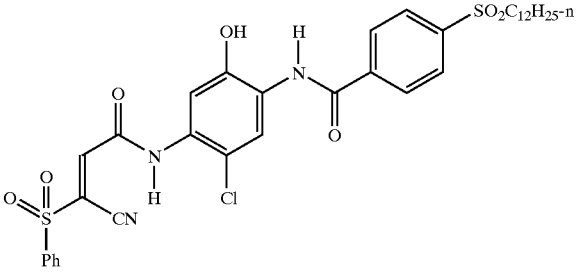
IC-14
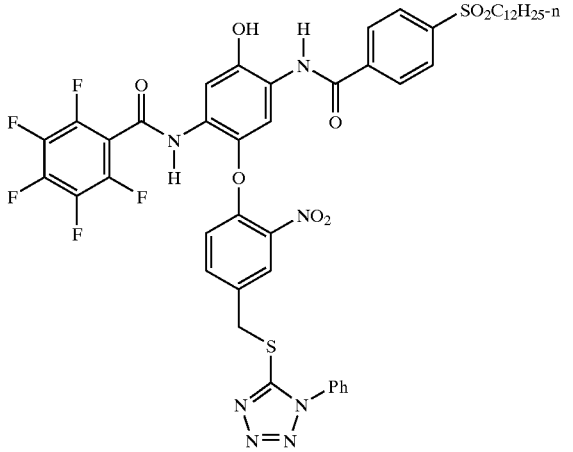

-continued
IC-15
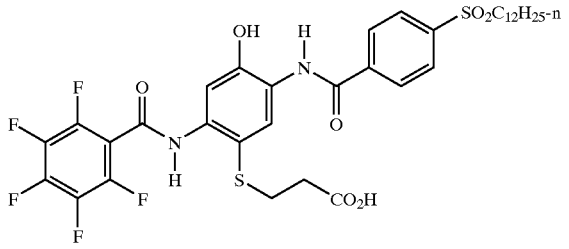
IC-16
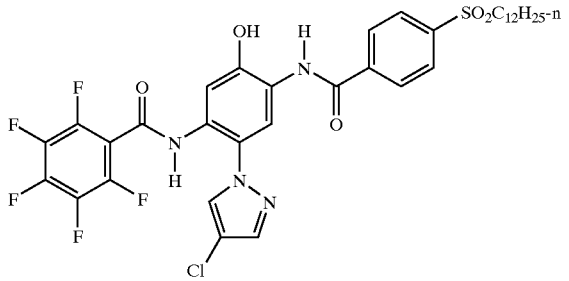
IC-17
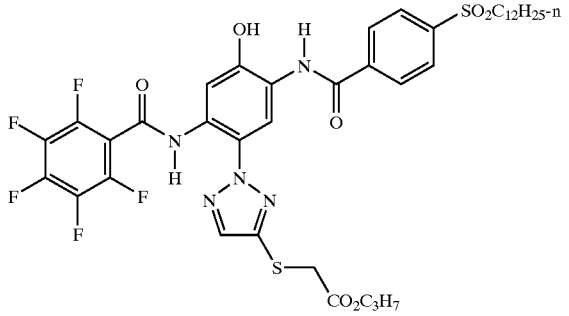
IC-18
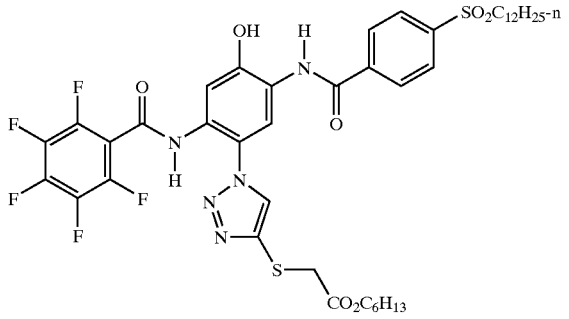
IC-19
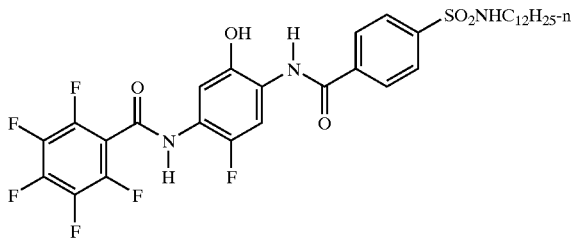
-continued
IC-20
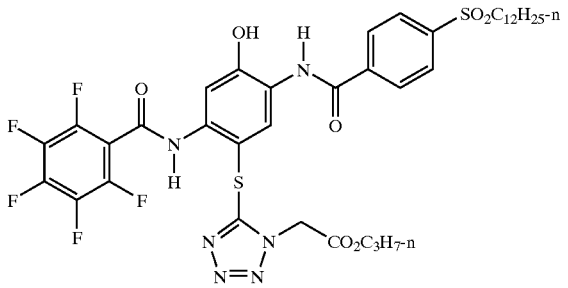
IC-21
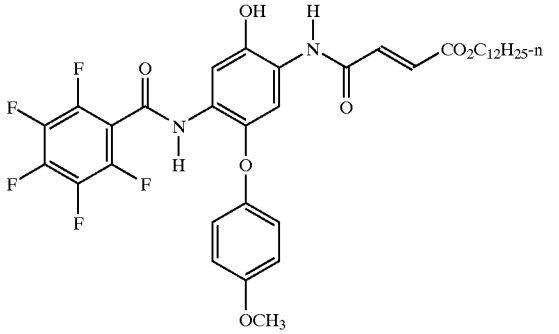
IC-22
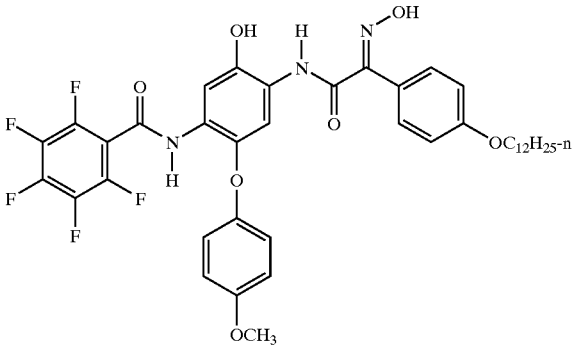
IC-23
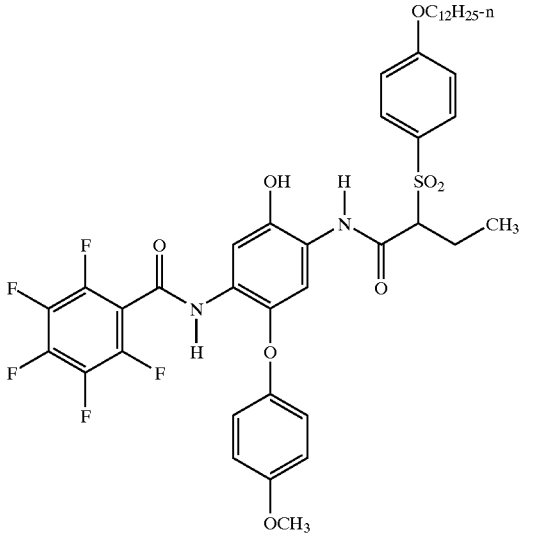

14. The photographic element of claim 1 comprising a support bearing at least one red sensitive photographic silver halide emulsion layer comprising at least one cyan image dye-forming coupler;

at least one green sensitive photographic silver halide emulsion layer comprising at least one magenta image dye-forming coupler of formula (I); and at least one blue sensitive photographic silver halide emulsion layer comprising at least one yellow image dye-forming coupler.

15. The element of claim 1 provided on a reflective support.

16. The element of claim 1 packaged with instruction to process using a color negative print developing process.

17. The element of claim 1 packaged with instructions to process using a color reversal developing process.

18. The element of claim 1 wherein the element is a direct-view element.

19. The photographic element of claim 1 in which the NB magenta coupler represents a coupler that forms a dye for which the left bandwidth (LBW) or right bandwidth (RBW) using spin-coating is at least 10 nm less than that of the same dye in solution form.

20. The photographic element of claim 1 in which the NB magenta coupler represents a coupler that forms a dye for which the left bandwidth (LBW) or right bandwidth (RBW) using spin-coating is at least 15 nm less than that of the same dye in solution form.

21. The photographic element of claim 1 in which the NB magenta coupler represents a coupler that forms a dye for which the left bandwidth (LBW) or right bandwidth (RBW) using spin-coating is at least 20 nm less than that of the same dye in solution form.

22. The photographic element of claim 1 wherein Y is a photographically useful group (PUG).

23. The photographic element of claim 1 wherein $R_1$ comprises a pentafluorophenyl group.

24. The photographic element of claim 1 wherein $R_1$ comprises a tetrafluoropyridyl group.

25. A photographic element comprising a light-sensitive silver halide emulsion layer having associated therewith a magenta coupler having the formula:

(II)

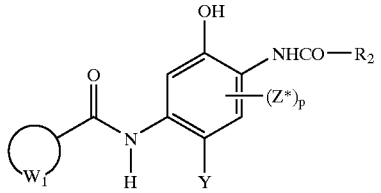

wherein:

$W_1$ represents the atoms necessary to complete a heterocyclic, carbocyclic, or alkenyl group with substituents of sufficient electron withdrawing capacity to obtain a spin-coated dye as described in the preceding subparagraph that exhibits a maximum absorption in the range of 520–590 nm;

Y is hydrogen or a coupling off group;

each Z* is an independently selected substituent group where p is independently 0 to 2;

$R_2$ is a heterocyclic or carbocyclic ring group, or an alkyl group;

provided that when $R_2$ is an alkyl group with an α-alkyl substituent, said α-alkyl substituent is unbranched; and provided further that the combined sum of the aliphatic carbon atoms in $W_1$, $R_2$ and all Z* is at least 8.

26. The photographic element of claim 25 wherein $R_1$ comprises a pentafluorophenyl group.

27. The photographic element of claim 25 wherein $R_1$ comprises a tetrafluoropyridyl group.

28. The photographic element of claim 25 wherein $R_1$ comprises a substituted alkenyl group.

29. A process for forming an image in an element as described in claim 1 after the element has been imagewise exposed to light comprising contacting the element with a color-developing compound.

30. The process of claim 29 in which the developer is a p-phenylene diamine compound.

31. The process of claim 29 in which the developer is 4-amino-3-methyl-N-ethyl-N-(2-methanesulfonamidoethyl) aniline sesquisulfate hydrate.

* * * * *